United States Patent [19]

Archibald

[11] Patent Number: 4,790,450

[45] Date of Patent: Dec. 13, 1988

[54] MEAT CONTAINER

[75] Inventor: William E. Archibald, Oklahoma City, Okla.

[73] Assignee: Wilson Foods Corporation, Oklahoma City, Okla.

[21] Appl. No.: 420,017

[22] Filed: Sep. 20, 1982

[51] Int. Cl.[4] ..... B65D 5/02; B65D 5/56

[52] U.S. Cl. ..... 220/418; 220/416; 220/443; 220/458; 229/3.1; 229/133; 229/143; 229/DIG. 2; B65D/5/02; B65D/5/56

[58] Field of Search ..... 220/416, 417, 418, 441, 220/443, 458; 229/2.5 R, 33, 3.1, 143, 133, DIG. 2; 426/129, 130, 127

[56] References Cited

U.S. PATENT DOCUMENTS

| | | | |
|---|---|---|---|
| 1,106,005 | 8/1914 | Shevlin | 229/3.1 |
| 1,699,844 | 1/1929 | Hertins | 229/3.1 |
| 2,403,855 | 7/1946 | Gilbert | 229/3.1 X |
| 2,523,488 | 9/1950 | Williamson | 229/133 |
| 3,085,731 | 4/1963 | Wilkins | 229/3.1 |
| 3,112,853 | 12/1963 | Welshenbach | 229/33 |
| 3,379,537 | 4/1968 | Brandt et al. | 426/130 X |
| 3,399,819 | 9/1968 | Rennie et al. | 229/3.1 X |
| 3,529,516 | 9/1970 | Dorsey et al. | 229/3.1 X |

OTHER PUBLICATIONS

"Packaging Analysis", a report by International Paper Co., Mar. 2, 1982.

*Primary Examiner*—Allan N. Shoap

*Attorney, Agent, or Firm*—Laney, Dougherty, Hessin & Beavers

[57] ABSTRACT

A container for shipping and temporarily storing fresh meat cuts which is a corrugated container of right parallelepiped construction and made up of interconnected corrugated panels. Each panel has a kraft paper outer liner with an outwardly facing wire side, a wax impregnated kraft paper inner liner and a medium positioned between the liners. Each opposed side wall of the box is made up of a pair of superimposed major flaps, and minor flaps extend from the opposite side edges of the panels making up the end walls of the box along and against portions of the outer side of the outermost major flap in each of the pairs of major flaps at opposite sides of the box.

13 Claims, 4 Drawing Sheets

MEAT CONTAINER

BACKGROUND OF THE INVENTION

1. Field of the Invention

This invention relates generally to containers for shipping meats, and more particularly, but not by way of limitation, to a container for packaging and shipping fresh pork loins and butts.

2. Description of the Prior Art

Various types of boxes and containers for shipment and temporary containment of pork loins and butts are well known in the art. The most widely used packaging technique consists of wrapping the pork in a paper wrap, and then placing it in a box container that is internally coated with a thin layer of wax. The container defines one or more holes to allow air circulation. The boxes are most commonly of the single wall or regular corrugated configuration.

One problem characteristic of this packaging assembly is that the wrapping of the pork with the paper wrap keeps the pork wet and difficult to cut at the retail stores. On the other hand, if the pork is shipped unwrapped in a box with air holes in it, the pork is subjected to contamination and excessive dehydration.

Another problem encountered with some types of containers previously used for pork containment is that the liquids (purge) which exude from the meat leak into and through the container, causing it to weaken and collapse, and similarly damage other meat containers stacked therebelow.

SUMMARY OF THE INVENTION

It is accordingly an object of the present invention to provide a means by which meats such as pork may be effectively shipped unwrapped in a container.

It is also an object of the invention to keep the pork from becoming dehydrated and undergoing excessive shrinkage in the coarse of shipment.

Another object is to provide a meat container which is sealed to prevent contamination, but which is constructed to breathe so as to permit a limited amount of air flow to occur.

Yet another object of the invention is to provide a container for pork loins or the like which does not become saturated from the juices or purge of the meat and which does not leak exuded liquids through seams or slots in the container.

Still another object of the invention is to provide a container which is relatively strong structurally, and which can be relatively economically constructed.

To facilitate achievement of the described objects, and additional advantages and objects which will hereinafter appear, the container of the present invention is in the form of a corrugated box of right parallelepiped configuration. At certain edges of the box which project vertically, the box is provided with slits (as opposed to slots) between adjacent panels, which slits do not extend the entire distance to the bottom panel of the box. Stated differently, these slits do not run the entire length of the box flaps having edges which are defined by the slits. This construction creates a tray formed by the bottom panel of the box in conjunction with a portion of the side and end panels at the time when the box is folded or assembled into its right parallelepiped configuration. The tray as thus formed functions to retain liquids exuded from the meat, hereinafter termed "purge", and prevents such purge from readily leaking from the box at the bottom corners thereof.

The top, bottom, side and end walls of the box are constructed of kraft liner board panels of the single wall type in which a medium is placed between an outside layer or liner and an inside layer or liner. In the box of the present invention, the outer liner of each panel is constructed so that the wire side of the kraft paper faces outwardly as opposed to the standard construction in boxes of this type in which the felt side of the paper faces outwardly. The inner liner of each panel is wax impregnated, in contrast to the conventional construction in which a layer or coating of wax is applied to the inner liner by a curtain coating process, or no wax at all is used. This construction, in which the outer liner is secured to the medium with the wire side facing outwardly and the felt side facing inwardly, and in which the inner liner is impregnated with wax, has been surprisingly found to not only allow excellent ventilation by the controlled passage of air from the inside to the outside of the box, but also permits the liquid content of the meat contained within the container to evaporate from the meat at a controlled rate so that optimum chilling of the meat is obtained without excessive shrinkage and drying of the meat. Moreover, the described construction of the paper or kraft liner board of which the box is made assures that the moisture is passed through the cardboard faster than it is absorbed therein, so that the paper board does not become soggy and weakened.

For a further understanding of the invention, and of further objects, features and advantages thereof, reference is made to the following description taken in conjunction with the accompanying drawings which illustrate a preferred embodiment of the invention.

BRIEF DESCRIPTION OF THE DRAWINGS

FIG. 8A is a cross-sectional view of the outer liner of the cardboard panel shown in FIG. 8.

FIG. 8B is a cross-sectional view of the inner liner of the cardboard panel shown in FIG. 8.

DETAILED DESCRIPTION OF A PREFERRED EMBODIMENT OF THE INVENTION

Figure 8:
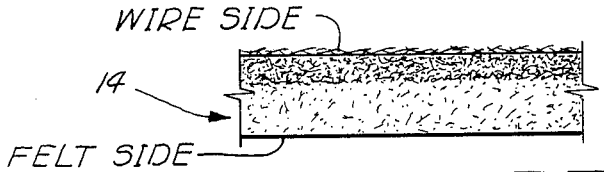
FIG. 8 is a cross-sectional view of the cardboard panels of which the container is constructed.

The meat container of the invention is made of single walled, regular corrugated type, kraft paper although the corrugated board could be of the double-walled form. The single-walled preferred embodiment of the container is made up from a blank 10 (see FIG. 1) which includes a plurality of interconnected panels as hereinafter described. Each panel includes a corrugated medium 12 disposed between an outer liner 14 and an inner liner 16 as shown in FIG. 8. These subelements of the kraft paper board panels which make up the box will be hereinafter described in greater detail.

The container of the invention is formed from the corrugated board blank 10 by folding the blank into a right parallelepiped configuration in which the container has a top, a bottom, opposed sides and opposed ends, each of rectangular configuration.

Figure 1:
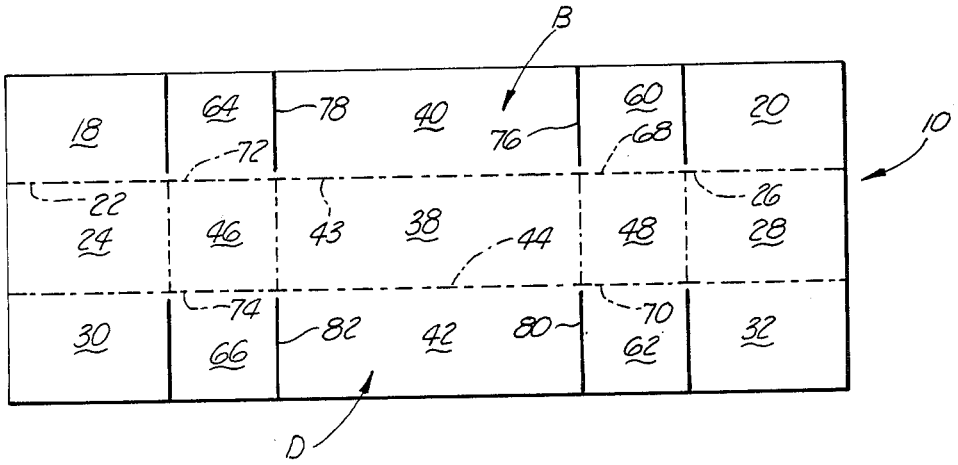
FIG. 1 is a plan view of a blank employed in constructing the container of the invention.
Figure 2:
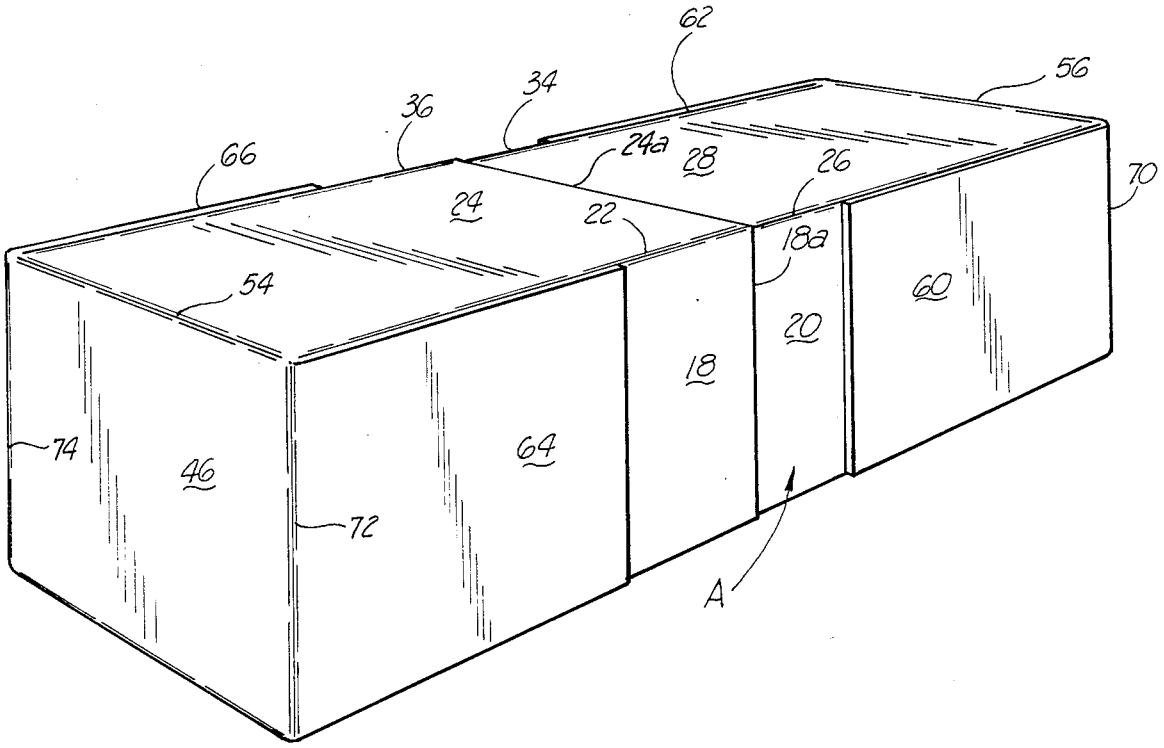
FIG. 2 is a perspective view of the container of the invention.
Figure 7:
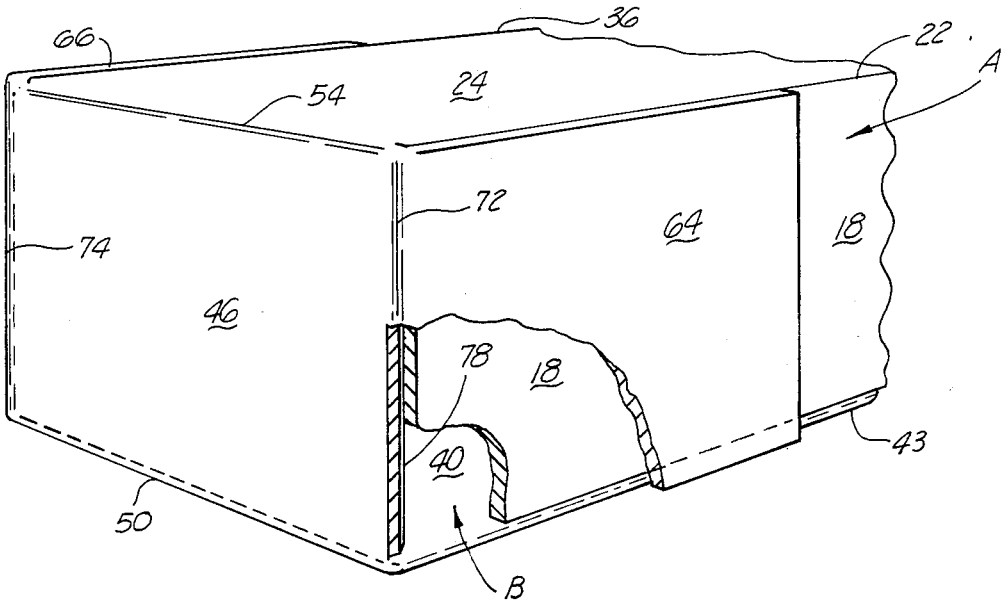
FIG. 7 is a perspective view of one corner of the container.

Referring initially to FIGS. 1 and 2, the container as there shown displays a side of the container which will be hereinafter termed the "first chimney side". The first chimney side of the container includes a rectangular outer major flap A which is superimposed over a rectangular inner major flap B (see FIGS. 3 and 7) which extends the full length and height of the container. The outer major flap A is formed by a pair of overlapped rectangular panels 18 and 20. The overlapped panels 18 and 20 are adhesively joined to each other in the area of overlap, and in FIG. 3, an outer terminal edge 18*a* of the panel 18 is depicted as a solid line, and the internal terminal edge of the panel 20 is depicted as a phantom line 20*a*.

The panel 18 is joined through a line of fold 22 to a rectangular panel 24 forming a portion of the top wall of the container as shown in FIG. 2, and the panel 20 is joined through a fold line 26 to a panel 28 forming a second portion of the container top wall. The panel 24 overlaps the panel 28 and has a free edge 24*a* exposed on the outer side of the box. The edge 28*a* of the panel 28 is illustrated as a phantom line. The panels 24 and 28 are adhesively secured to each other in the area of overlap.

Figure 3:
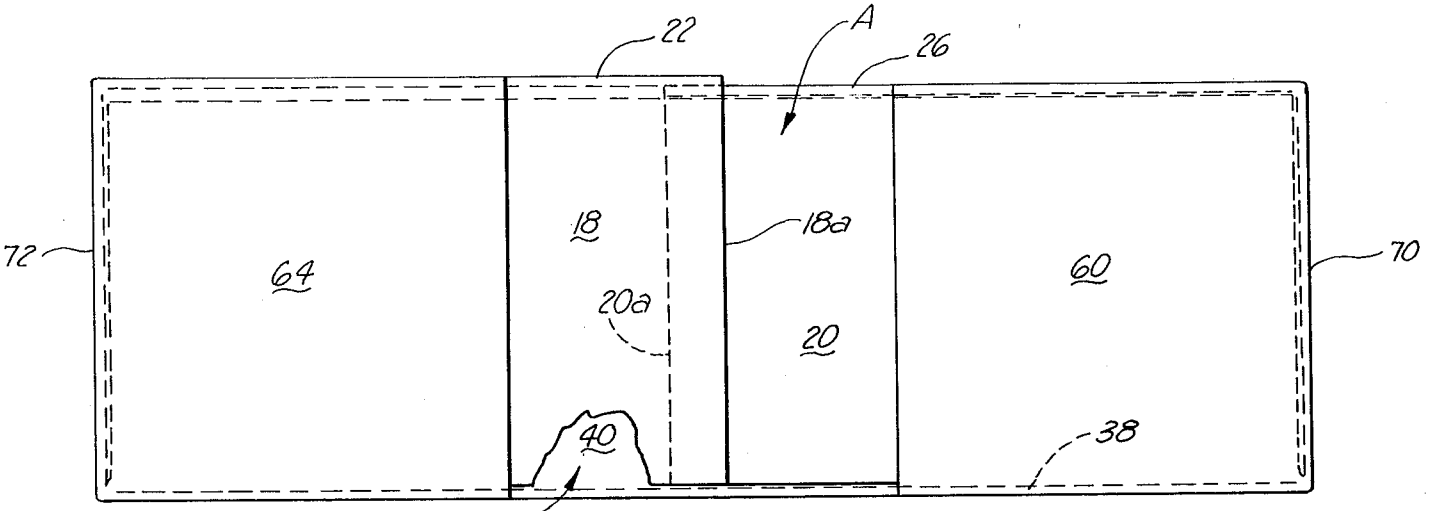
FIG. 3 is a side view of a preferred embodiment of the container of the invention.
Figure 4:
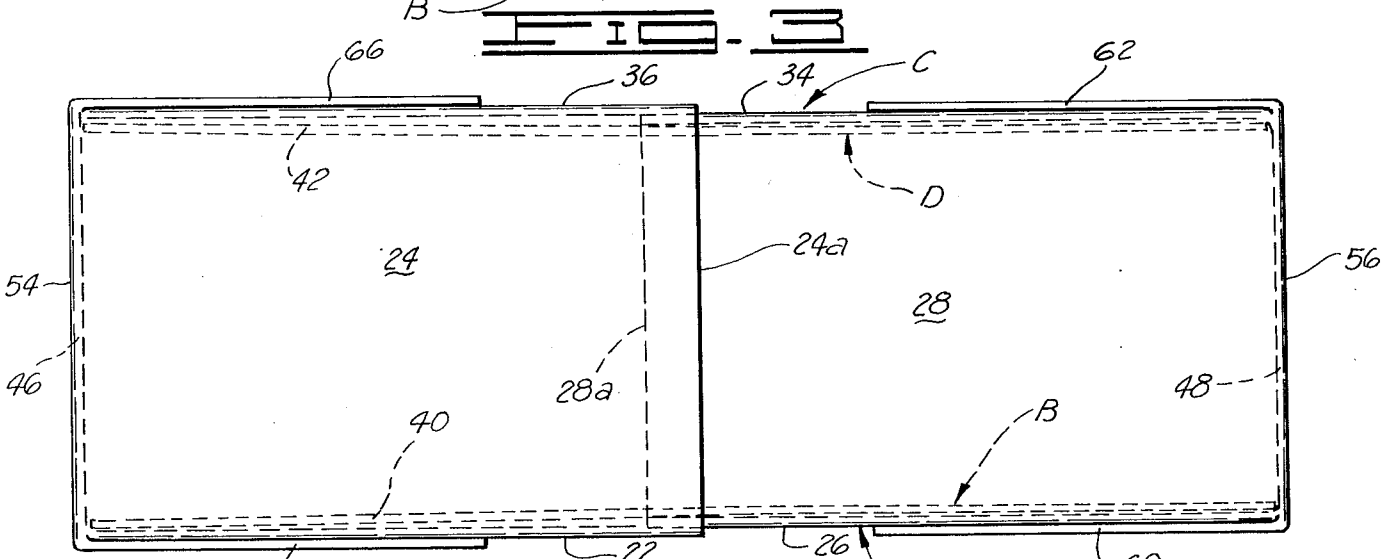
FIG. 4 is a top view of the container illustrated in FIG. 3.
Figure 5:
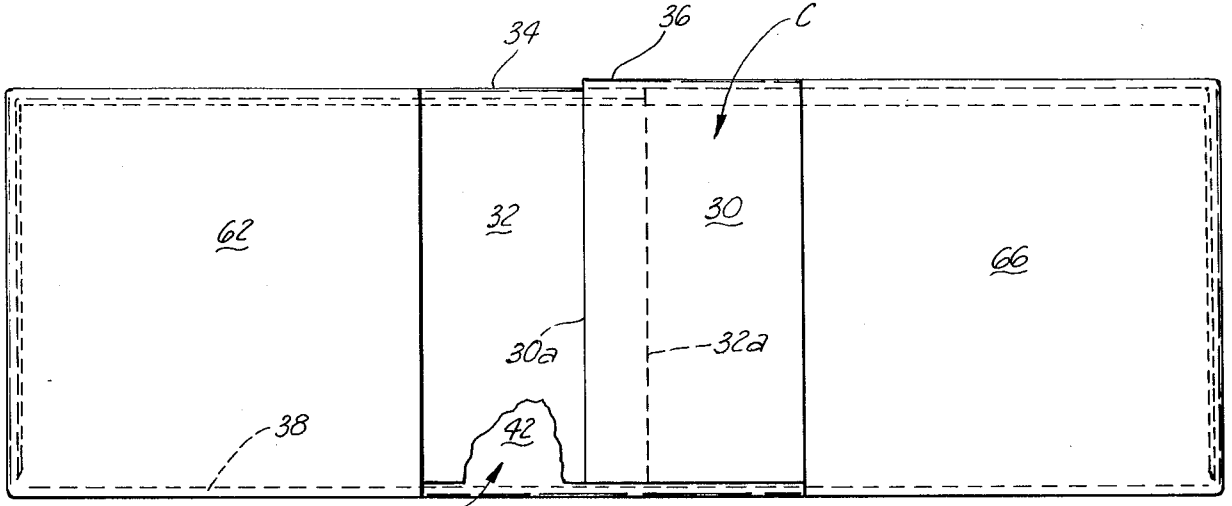
FIG. 5 is a side view of the container illustrated in FIG. 3 illustrating the opposite side of the container from that shown in FIG. 3.

The side wall of the box opposite the "first chimney side" is depicted in FIG. 5, and is referred to as the "second chimney side". This second chimney side includes a rectangular outer major flap C which is superimposed over a rectangular inner major flap D (see FIG. 5) which extends the length and height of the container. The outer major flap C is formed by a pair of overlapped rectangular panels 30 and 32. The overlapped panels 30 and 32 are adhesively joined to each other in the area of overlap, and as illustrated in FIG. 3, an outer terminal edge 30*a* of the panel 30 is exposed on the outer side of the box, and an inner terminal edge 32*a* of the panel 32 is disposed toward the inside of the box and is illustrated as a phantom line. The panel 30 is connected to the panel 24 by means of a fold line 36, and the panel 32 is connected to the panel 28 by means of a fold line 34.

Figure 6:
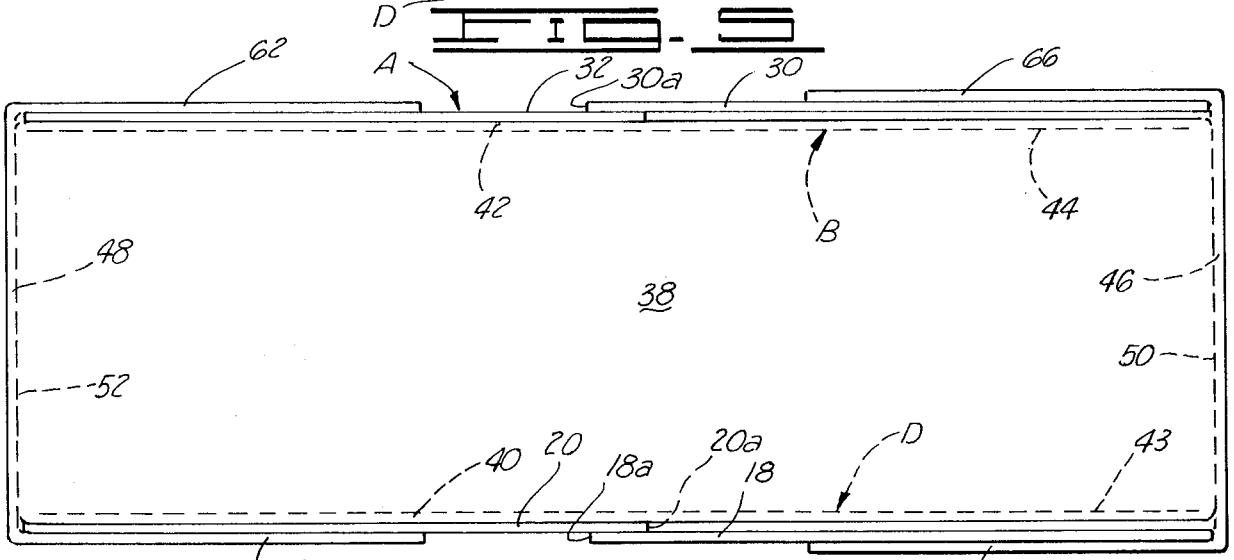
FIG. 6 is a bottom view of the container of FIG. 3.

The bottom of the container is shown in FIG. 6 and consists of a single elongated rectangular panel 38 which extends from one end of the box to the other. The panel 38 forming the bottom wall of the container is formed integrally with the rectangular inner major flaps B and D. The inner major flaps B and D, which project inside of, and are flatly abutted against, the outer major flaps A and C, as hereinbefore described, are each constituted by a single elongated rectangular panel. The panel constituting inner major flap B is denominated by reference numeral 40 and that which constitutes the inner major panel D is denominated by reference numeral 42. The panel 38 is joined to the panels 40 and 42 through fold lines 43 and 44, respectively, and when the box is assembled and used to contain meat, extends at right angles to these panels.

For purposes of forming the opposite end walls of the container, a pair of parallel, rectangular end panels 46 and 48 are formed integrally with the bottom panel 38, and are interconnected thereto by fold lines 50 and 52, respectively, so that the end panels extend normal to the bottom panel. The end panel 46 is also formed integrally with the panel 24 forming a portion of the top wall of the box and is joined thereto through a fold line 54, and the panel 48 is formed integrally with the panel 28 forming a second portion of the top of the box and is joined thereto through a fold line 56.

The container of the invention further includes four minor flaps 60–66. The minor flaps 60 and 62 are connected through fold lines 68 and 70, respectively, to the opposite sides of end panel 48. When the box is assembled and sealed for shipment, the minor flaps 60 and 62 lie flatly along and against the outer major flaps A and C, respectively, at the opposite sides of the container, as best illustrated in FIGS. 1–6. In the same fashion, and according to the same constructional aspect, the minor flaps 64 and 66 are integrally formed with the end panel 46, and are interconnected thereto by fold lines 72 and 74, respectively. The minor flaps 64 and 66, in the assembled form of the box, lie flatly against the respective outer major flaps A and C, respectively, of the container as shown in FIGS. 1–5.

In referring to the blank 10 from which the box is formed as shown in FIG. 1, it will be perceived that the inner major flaps B and D which have been described, and the minor flaps 60–66, are formed by slitting the blank at certain locations. Thus, the inner major flap B is separated from the minor flaps 60 and 64 by means of slits 76 and 78, respectively, which extend perpendicular to the fold line 43 which joins the bottom panel 38 to the inner major flap B. The slits 76 and 78 are formed with a thin knife or cutting instrument, and are to be distinguished from slots which would connote a separation effected so that there would be a significant space left between the minor flaps 60 and 64 and the inner major flap B. The inner major flap D is also severed from the minor flaps 62 and 66 by means of slits 80 and 82, respectively, which extend at right angles to the fold line 44 which joins the bottom panel 38 to the major inside flap D.

An important aspect of the construction of the present invention resides in the fact that the slits 76–82 are not projected entirely into the respective fold lines 43 and 44 which interconnect the inner major flaps B and D, respectively, to the bottom panel 38 of the box. This feature assures that a tray having liquid impervious, substantially leak-proof corners is formed at the bottom of the box. Preferably, the slits are terminated at a point which is from about $\frac{1}{4}$ inch to about $\frac{3}{4}$ inch from the respective nearest adjacent fold lines.

Because the slits 76–82, in each case, do not extend for the full width of either of the inner major panels B and D which they bound, or of the minor panels 60–66 which they function to separate from these major panels, and do not intersect the fold lines 43 and 44 by which the major panels B and D, respectively, are interconnected to the bottom panel 38, the effect is to create tray corners which are of liquid-tight integrity because the corners are not traversed by any slit or cut used in forming the box. In different words, the bottom panel 38, in conjunction with the upwardly projecting, immediately adjacent portions of the inner major flaps B and D, and portions of the end panels 46 and 48, forms a tray capable of retaining the exudate or purge which may be said to generally accumulate in any container used for the shipment of fresh meats.

Another important aspect of the present invention is the way in which the several corrugated board panels developed in forming the box are specifically constructed. Thus, as previously pointed out, the corrugated board used in the construction of each of the panels includes an outer liner 14, a medium 12, and an inner liner 16 which faces the inside of the box or container. As is well understood in the art, each of the liners, as well as the medium, is characterized in having what is termed in the art a "felt" side and a "wire" side. These terms refer to the surface characteristics of the kraft paper material of which the corrugated board is made, as such surface characteristics are developed in the manufacturing process. The wire side is composed of relatively longer and coarser pulp fibers than is the felt side. The felt side is composed of relatively small and shorter fibers. The effect of this is that the wire side is a rougher surface in which a larger surface area of the fibers making up the paper is exposed as compared to the relatively smoother felt side.

In conventional cardboard box construction, the box is constructed so that the felt side of the outer liner faces outwardly or, in another orientation, away from the medium or inside of the box. In the present invention the wire side of the outer liner 14 faces outwardly as shown in FIG. 8A. This is for the purpose of providing a relatively high surface area, afforded by the longer coarser fibers, to provide a higher rate of moisture evaporation. This feature, in conjunction with the wax impregnation of the felt side, as hereinafter described, allows the panels to breathe, and moisture from the enclosed meat to transude the cardboard panels at a controlled rate and without saturating or excessively dampening the panels. Facing the wire side of the outer liner outwardly also imparts a relatively high coefficient of friction to the outer side of the container and improves load unitizing during shipment of the containers.

In other aspects of the present invention, it is preferred that the kraft paper employed in the construction of the inner liner 16 be made by a wet finishing technique rather than a dry finishing technique since the wet finishing applied to the inside liner aids in slowing down the rate of passage of water vapor into the cardboard as hereinafter described.

It is also preferred that the panels be constructed utilizing an A flute medium rather than a C or B flute medium, since the maximum stacking strength is imparted to the containers by the use of the A flute medium. The "flute" refers to the amplitude of the corrugations in the medium, and the number of corrugations per inch and its meaning and utilization in cardboard construction is well understood in the art. Though the A flute medium is the preferred construction in the container of the invention, B or C flute medium elements can also be utilized. The C flute medium is frequently more readily available.

An important aspect of the present invention is the wax impregnation of the inner liner 16. In the conventional construction of cardboard containers for containment and shipment of fresh meat, the inner liner is coated with a thin layer of wax by a curtain coating process. The thin layer of wax has the deleterious effect of sealing the inner liner against moisture penetration and preventing the box from "breathing". In the construction of the container of the present invention, curtain coating to apply a coating of wax to the inner liner is not utilized. Rather, the inner liner is impregnated by a heating process which drives a small amount of wax into the relatively short wood fibers at the inwardly facing felt side of the liner. Preferably, about five pounds of paraffin wax is used for impregnating 1000 board feet of the inner liner of the container from the felt side inwardly. In other terms, the inner liner 16, in the case of the container of the present invention, is said to be "dry waxed" whereas the curtain coating process used in the prior art is sometimes referred to as "wet waxing". In impregnating the fibers at the felt side of the inner liner, the method of impregnation is such that the surface is not sealed, but the wax accumulation is interfibular with the ends of the fibers exposed so as to wick moisture at a controlled rate into the liner.

The procedure of wax impregnating the felt side of the inner liner permits the panels to pick up and absorb moisture more slowly, and in better controlled synchronism with the ability of the outwardly facing wire side of the outer liner to disseminate water vapor to the atmosphere. Thus, the panels do not become weak from absorption of excessive moisture without adequate ability to transpirate this moisture from the panel to the atmosphere. In another way of viewing the construction of the panels according to the present invention, a relatively efficient evaporative surface is provided by the large fibers in the wire side of the outer liner, and the inner liner acts somewhat as a flow control valve, controlling the rate of water passage into the panel commensurate with the evaporation rate at the outer liner, so that excessive water does not accumulate in the body of the panel and cause it to become weak and soggy.

The elimination of curtain coating at the inner side of the inner liner is an important improvement in the present invention since such curtain coating prevents or severly curtails air flow through the panels and it is important, particularly in the containment of fresh pork, to alleviate a condition in which the pork is "smothered", or subjected to a stale impassive air environment. In some cases, in order to avoid this air flow restriction, some prior types of meat containers have avoided completely any wax treatment of the inside liner. These boxes, however, tend to pass water vapor into the corrugated board panel too rapidly, with the result that the panel more quickly becomes soggy or weakened due to contained moisture.

In the construction and utilization of the container of the invention, the blank 10 is first converted by a converting facility so that a so-called manufacturer's joint is formed in the blank 10 by overlapping the paired panels 24 and 28 which make up the top of the box, and the paired panels of the two major flaps A and C, and then joining these overlapping panels with a suitable adhesive. The blank 10, as thus modified, is then shipped to the meat packer in a flattened condition.

When the packer is ready to pack the containers with pork loins or butts, or other fresh meat, the box is folded from a flat status to an open position in which the manufacturer's joint which joins the panels 24 and 28 forming the top of the box is in fact located at the top of the box. This positions the panel 38 at the bottom of the box. The meat to be packaged can then be placed within the box, and following this, the two inner major flaps B and D are folded upwardly about the fold lines 43 and 44 so as to extend vertically and at right angles with respect to the panel 38 forming the bottom of the box. The outer major flaps A and C are then folded downwardly about the fold lines 22, 26, 34 and 36 so as to lie flatly against the inner major flaps B and D and form the double layered side walls (the first and second chimney walls) of the box.

Last, the minor panels 62–66 are folded about the fold lines 68–74 so that the minor flaps lie flatly against the end portions of the outer major flaps A and C as illustrated in FIGS. 2–7 of the drawings. The minor flaps may then be either glued in this position by adhesive securing them to the outer major flaps A and C, or they may be secured in their illustrated overlapping positions by means of strapping extended around the container.

It will be apparent, of course, that in lieu of placing the pork in the box while both of the side walls are still opened, the entire box may be closed except for one of the sides thereof, the meat placed in the box at this time, and then the last side of the box formed by folding the inner and outer major flaps, C and D, into juxtaposition, followed by folding the respective minor flaps 62 and 66 into position against the outer sides of the end portions of the just closed major flap C.

During storage and shipment, some of the liquids from the meat (the purge) will be expelled from the meat into the bottom portion of the container. The unique construction of the box provides a tray at this location for the containment of such liquids. Moreover, the manner in which the corrugated board panels are constructed assures that such exuded liquid or purge will demonstrate less propensity to make the box soggy and weak. This occurs as a result of the efficient removal of moisture and water vapor from the interior of the box due to the high evaporative surface constituted by the outwardly facing wire side of the outer liner of each panel, and the controlled rate at which liquid or moisture is permitted to penetrate each panel due to the wax impregnation of the felt side of the inner liner.

Importantly in the construction of the box, the rate of evaporation of moisture from the surface of the meat stored in the box is controlled so that optimized cooling of the meat is attained without excessive shrink. The term "shrink" refers to the loss of weight due to loss of moisture from the meat, and the economic return to the packer, as well as to the butcher, is directly related to the amount of shrink which the meat undergoes between the point of packing and the end user. By controlling the rate of evaporation of moisture from the meat, and controlling the humidity and temperature within the box, the box constructin of the present invention permits optimization of cooling rate and minimization of shrink loss.

The construction of the box of the present invention is also quite important in affording substantially enhanced strength to the box. Particularly important in this regard is the manner in which the minor flaps 60–66 are folded to the outside of the outer major flaps A and C. In this position, the minor flaps provide an extra brace along the chimney sides of the container, and afford greater compressive strength to the box.

Figure 9:
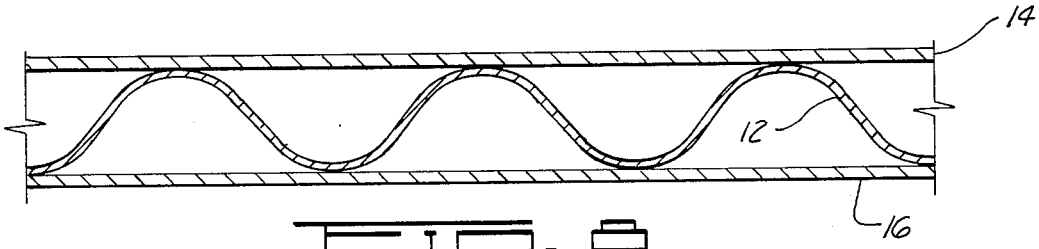
FIG. 9 is a top view of portions of two of the containers stacked adjacent each other.
Figure 10:
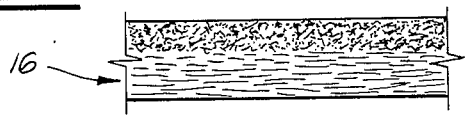
Figure 11:
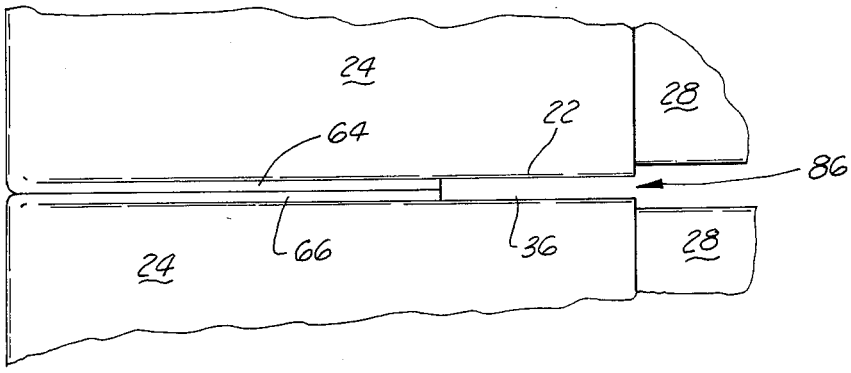

Further, the placement of the minor flaps 60–66 on the outer side of the outer major flaps A and C allows a chimney effect to be developed at the time that the boxes are stacked in side-by-side relation. This stacking arrangement is illustrated in FIG. 9 of the drawings. It will there be noticed that a chimney space 86 is caused to exist between two of the outer major flaps A and C of adjacent containers by reason of the spacing necessitated by abutting contact of the outwardly lying minor flaps 64 and 66. This chimney space allows a free flow of air up through the stacked containers, and this in turn aids in achieving excellent ventilation of the meat stored in the boxes. In other words, when the ventilating effect acts in cooperation or conjunction with the controlled air flow through the panels as hereinbefore explained to assure controlled moisture removal from the interior of the container at an optimized rate.

Although a preferred embodiment of the invention has been herein described in order to enable those skilled in the art to sufficiently comprehend the principles of the invention to follow and practice it, it will be understood that various changes and modifications in the specifically described construction can be effected without departure from such underlying basic principles. Changes and innovations of this type are therefore deemed to be circumscribed by the spirit of the invention except as the same may be necessarily limited by the appended claims or reasonable equivalents thereof.

What is claimed is:

1. A container for containing fresh cuts of meat comprising:

a single corrugated board element including a plurality of panels separated by slits and fold lines, said element being folded into a hollow, completely enclosed, right parallelepiped configuration to provide the container with two opposite parallel sides, a top, a bottom and two opposite parallel ends, said board element and each of the panels thereof including:

an outer liner including:

an inwardly facing felt side; and an outwardly facing wire side, said wire side containing relatively longer and coarser fibers of greater exposed surface area than said felt side and providing a wicking action for transpiring water vapor from inside the container to the outside of the container;

an inner liner; and a corrugated medium located between the inner and outer liners and bonded to said inwardly facing felt side of said outer liner; and wax impregnated into said inner liner from the side thereof opposite said corrugated medium to render said liner liquid impermeable to thereby prevent water in liquid form from passing through said inner liner from the interior of said container and whereby said panels pick up and absorb water vapor and moisture more slowly at the inner liner due to said wax impregnation than would occur without any wax impregnation and said outer liner transpires moisture in the form of water vapor to the outside of the box relatively rapidly due to the outward facing of said wire side of said outer liner, and moisture accumulation in the panels between the inner and outer liners that can cause weakness and sogginess of the panels is prevented.

2. A container as defined in claim 1 wherein each of said parallel sides includes a pair of overlapped, superimposed major flaps, and a pair of spaced minor flaps disposed on the outer side of said major flaps.

3. A container as defined in claim 1 wherein said container includes four liquid imperforate corners adjacent the corners of said bottom.

4. A container as defined in claim 1 wherein each of the sides of said container includes:

a single panel connected to said bottom and projecting normal and vertically with respect thereto and forming an inner major flap; and an outer major flap flatly abutting, and lying outside of, said inner major flap, said outer major flap including a pair of overlapped, adhesively joined panels each connected through a fold line to the top of the container.

5. A container as defined in claim 1 wherein each of said panels is rectangular, and said panels include:

a bottom panel;

a pair of opposed, parallel, spaced end panels joined through fold lines to said bottom panel;

a pair of spaced inner major flap panels joined through fold lines to the opposite sides of said bottom panel and forming parts of the sides of the container;

a pair of partially overlapped top panels each joined through a fold line to a different one of said end panels than the other, and joined to each other where partially overlapped;

a first pair of overlapped major flap panels connected through fold lines to said top panels;

a second pair of overlapped major flap panels connected through fold lines to said top panels and spaced across said top panels from said first pair of major flap panels.

6. A container as defined in claim 5 wherein said first pair of major flap panels is positioned outside of and flatly against one of said inner major flap panels; and said second pair of major flap panels is positioned outside of and flatly against the other of said inner major flap panels.

7. A container as defined in claim 6 wherein said container further includes a first pair of minor flap panels connected to the opposite side edges of one of said end panels; and a second pair of minor flap panels connected to the opposite side edges of the other of said end panels.

8. A container as defined in claim 7 wherein said first pair of major flap panels is positioned between one of the minor flap panels in each of the first and second pairs thereof, and one of said inner major flap panels; and wherein said second pair of major outer flap panels is positioned between the other of said inner major flap panels and one of the minor flap panels in each of the first and second pairs thereof.

9. A container as defined in claim 1 wherein the bottom portion of said container is formed as a liquid-confining tray having no slits therein, said bottom portion of said tray including said bottom, parts of said opposite parallel ends connected to said bottom by fold lines, and parts of said parallel sides connected to said bottom and to said parallel ends by fold lines.

10. A container for fresh cuts of meat comprising:

a bottom panel;

side walls including flaps formed integrally with said bottom panel and extending perpendicularly upwardly therefrom;

end wall panels formed integrally with said bottom panel and extending perpendicularly upwardly therefrom and at right angles to said side wall flaps, each of said end wall panels including portions adjacent said bottom panel which are formed integrally with lower portions of said flaps and cooperate with said lower portions of said flaps and said bottom panel to form closed, liquid imperforate corners, and said bottom panel and the lower portions of said side wall flaps and end wall panels together forming an unslitted tray located at, and constituting, the bottom portion of said container and including said imperforate corners; and a container top extending between said side wall flaps and parallel to said tray bottom panel, and completely closing said container, said bottom panel and container top each being craft corrugated board including:

an inner liner;

an outer liner; and a corrugated medium positioned between said outer liner and said inner liner, said outer liner having a wire side located on the opposite side of the outer liner from the side thereof adjacent the medium, and having a felt side adjacent the medium.

11. A container as defined in claim 10 wherein said inner liner is impregnated with paraffin wax.

12. A corrugated box for containing fresh cuts of meat comprising:

a series of interconnected imperforate panels folded and joined to form a close hollow right parallelepiped, each of said panels including:

a kraft paper outer liner positioned at the outside of the box and including an outwardly facing wire side and an inwardly facing felt side;

a kraft paper inner liner positioned inwardly in the hollow parallelepiped from the outer liner and including a wire side facing toward said outer liner and an inwardly facing felt side;

a corrugated medium between said inner and outer liners and secured to the felt side of said outer liner and the wire side of said inner liner;

wax impregnated into said inner liner from the felt side thereof in an amount of about five pounds of paraffin wax per 1,000 sq. ft. of surface area of the inner liner; and means for inhibiting liquid leakage through four corners of the hollow right parallelepiped.

13. A cardboard box as defined in claim 12 wherein said leakage inhibiting means comprises a tray disposed at a bottom side of said right parallelepiped, said tray comprising:

a bottom panel;

end panel portions connected through fold lines to the opposite ends of said bottom panel; and side wall inner flap panel portions connected through fold lines to said bottom panel.

* * * * *